US009638503B1

(12) United States Patent
Andrews et al.

(10) Patent No.: US 9,638,503 B1
(45) Date of Patent: May 2, 2017

(54) DUAL SAFETY FUZE FOR GRENADE

(71) Applicants: William J. Andrews, Tampa, FL (US); Carl J. Campagnuolo, Sarasota, FL (US)

(72) Inventors: William J. Andrews, Tampa, FL (US); Carl J. Campagnuolo, Sarasota, FL (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 442 days.

(21) Appl. No.: 14/462,702

(22) Filed: Aug. 19, 2014

(51) Int. Cl.
*F42C 15/20* (2006.01)
*F42C 14/02* (2006.01)
*F42C 15/00* (2006.01)
*F42C 15/21* (2006.01)

(52) U.S. Cl.
CPC ..... *F42C 15/005* (2013.01); *F42C 14/02* (2013.01); *F42C 15/21* (2013.01)

(58) Field of Classification Search
CPC ..... F42C 14/02; F42C 14/025; F42C 15/005; F42C 15/20; F42C 15/21
USPC ..... 102/482–488, 202.1
See application file for complete search history.

(56) References Cited

U.S. PATENT DOCUMENTS 2,203,640 A * 6/1940 Hines ..... F42C 14/02 102/261
3,049,999 A * 8/1962 Sunden ..... F42C 9/142 102/487
3,498,223 A * 3/1970 Andersson ..... F42B 27/00 102/221
3,731,631 A * 5/1973 Berlin ..... F42C 14/02 102/487
3,742,855 A * 7/1973 Webb ..... F42C 14/02 102/261
3,762,330 A * 10/1973 Hall ..... F42C 14/02 102/487
4,513,667 A * 4/1985 Caruso ..... F42C 14/02 102/482
H215 H * 2/1987 Stewart ..... F42C 19/00 102/487
4,926,752 A * 5/1990 DiRubbio ..... F42C 14/02 102/202.13
8,561,540 B1 * 10/2013 Lauch ..... F42C 15/188 102/258
8,857,341 B1 * 10/2014 Andrews ..... F42C 14/02 102/486
2006/0283346 A1 * 12/2006 Luebbers ..... F42C 14/02 102/487
2012/0145029 A1 * 6/2012 Veksler ..... F42C 15/34 102/481

* cited by examiner

*Primary Examiner* — Bret Hayes
(74) *Attorney, Agent, or Firm* — Michael C. Sachs

(57) ABSTRACT

A hand grenade fuze includes a secondary safety feature in the form of a trigger pin inserted through the striker lever. One end of the trigger pin has an undercut portion. A slide bar is disposed in the fuze body and has a keyhole opening at one end for selectively engaging the undercut portion of the trigger pin. A trigger has one end connected to the slide bar and another end rotatably fixed to the fuze body. A spring biases the trigger away from the fuze body. When the trigger is depressed, the slide bar translates and releases the trigger pin, which releases the restraint on the striker lever.

8 Claims, 5 Drawing Sheets

DUAL SAFETY FUZE FOR GRENADE

STATEMENT OF GOVERNMENT INTEREST

The inventions described herein may be manufactured, used and licensed by or for the United States Government.

BACKGROUND OF THE INVENTION

The invention relates in general to hand grenades and in particular to the activation or arming of hand grenades.

A major concern in the field of munition fuzes is safety. Safety is improved by providing dual safety activation for fuzes. A known fuze design for grenades includes a fuze pull ring that secures a fuze lever to a fuze body or assembly. When the pull ring is detached from the fuze assembly, the only way to prevent initiation of the grenade is for the user to hold down the fuze lever. When the fuze lever is released, the grenade initiation process begins and the grenade will explode soon after.

It is possible that the fuze pull ring may be accidentally caught on an object and dislodge from the grenade. Such a possibility could be very hazardous to the user and others near the user.

A need exists for a secondary safety feature for a grenade fuze.

SUMMARY OF INVENTION

One aspect of the invention is a grenade fuze having a fuze body and a striker lever rotatably mounted to the fuze body. A rotor assembly is rotatably mounted to the fuze body. A spring torsionally biases the rotor assembly. A pull ring having a pull pin is inserted through the striker lever to restrain rotation of the striker lever and the rotor assembly.

A trigger pin having a longitudinal axis is inserted through the striker lever to restrain rotation of the striker lever. One end of the trigger pin includes an undercut portion. A slide bar is disposed in the fuze body and has a keyhole opening at one end for selectively engaging the undercut portion of the trigger pin. A trigger has one end connected to the slide bar and another end rotatably fixed to the fuze body. A second spring biases the trigger away from the fuze body.

The keyhole opening includes a small opening and a large opening. Engagement of the undercut portion of the trigger pin with the small opening restrains translation of the trigger pin with respect to the slide bar in a direction along the longitudinal axis of the trigger pin.

Placement of the trigger pin in the large opening of the keyhole opening does not restrain translation of the trigger pin with respect to the slide bar in the direction along the longitudinal axis of the trigger pin.

In an unactuated position of the trigger, the slide bar prevents translation of the trigger pin with respect to the slide bar in the direction along the longitudinal axis of the trigger pin.

When the trigger is depressed, the slide bar does not prevent translation of the trigger pin with respect to the slide bar in the direction along the longitudinal axis of the trigger pin.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

A novel grenade fuze includes dual safety features. The dual safety features include a fuze pull ring, such as a conventional fuze pull ring, and a secondary safety feature. The secondary safety feature operates in parallel with the pull ring to restrain the fuze lever in its safe position. The safe position of the fuze lever is the position of the fuze lever when the pull ring has not been removed and the secondary safety feature is engaged.

Figure 2:
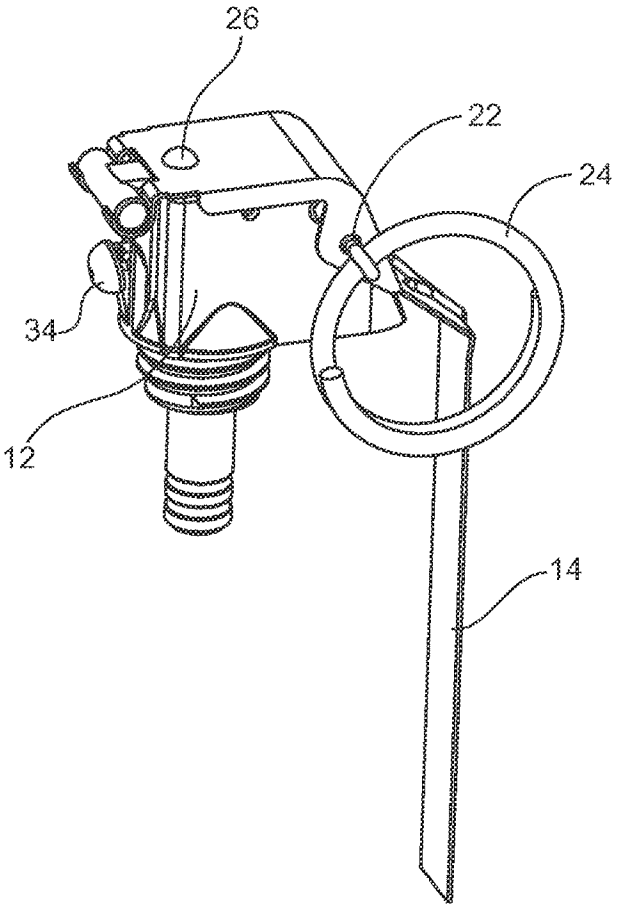
FIG. 2 is a perspective view of the grenade fuze assembly.
Figure 1:
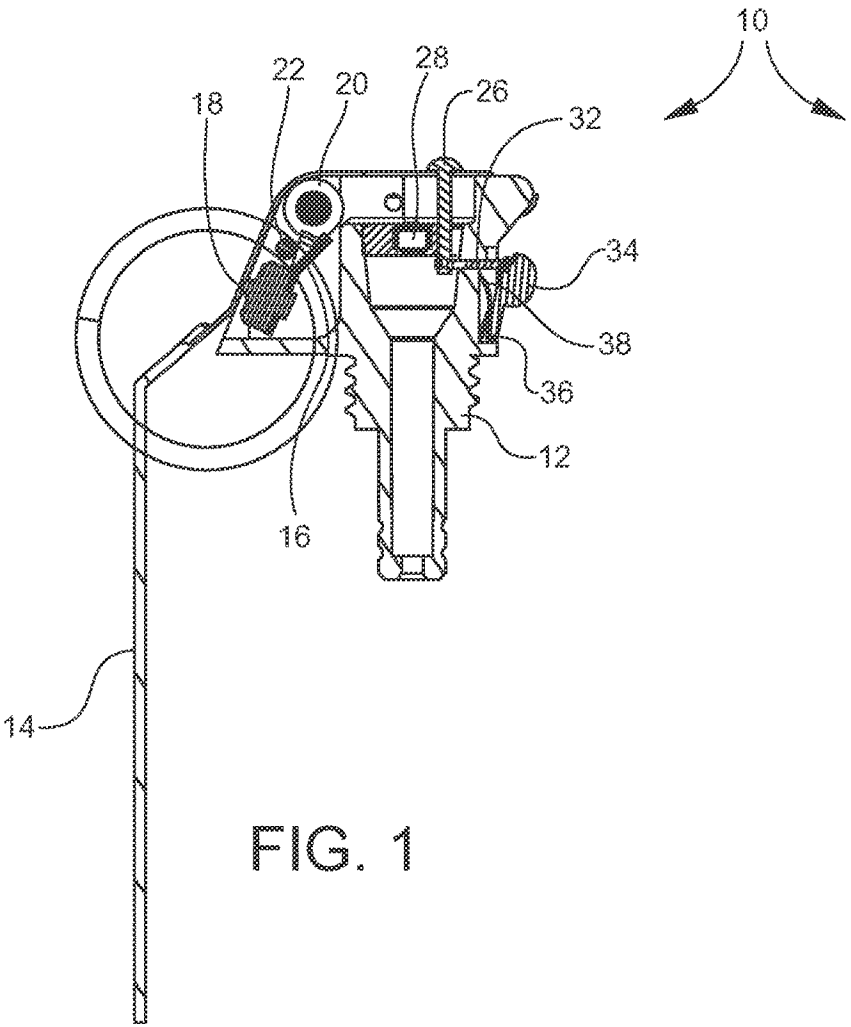
FIG. 1 is a side sectional view of one embodiment of a novel grenade fuze assembly in a safe or unarmed state.
Figure 3:
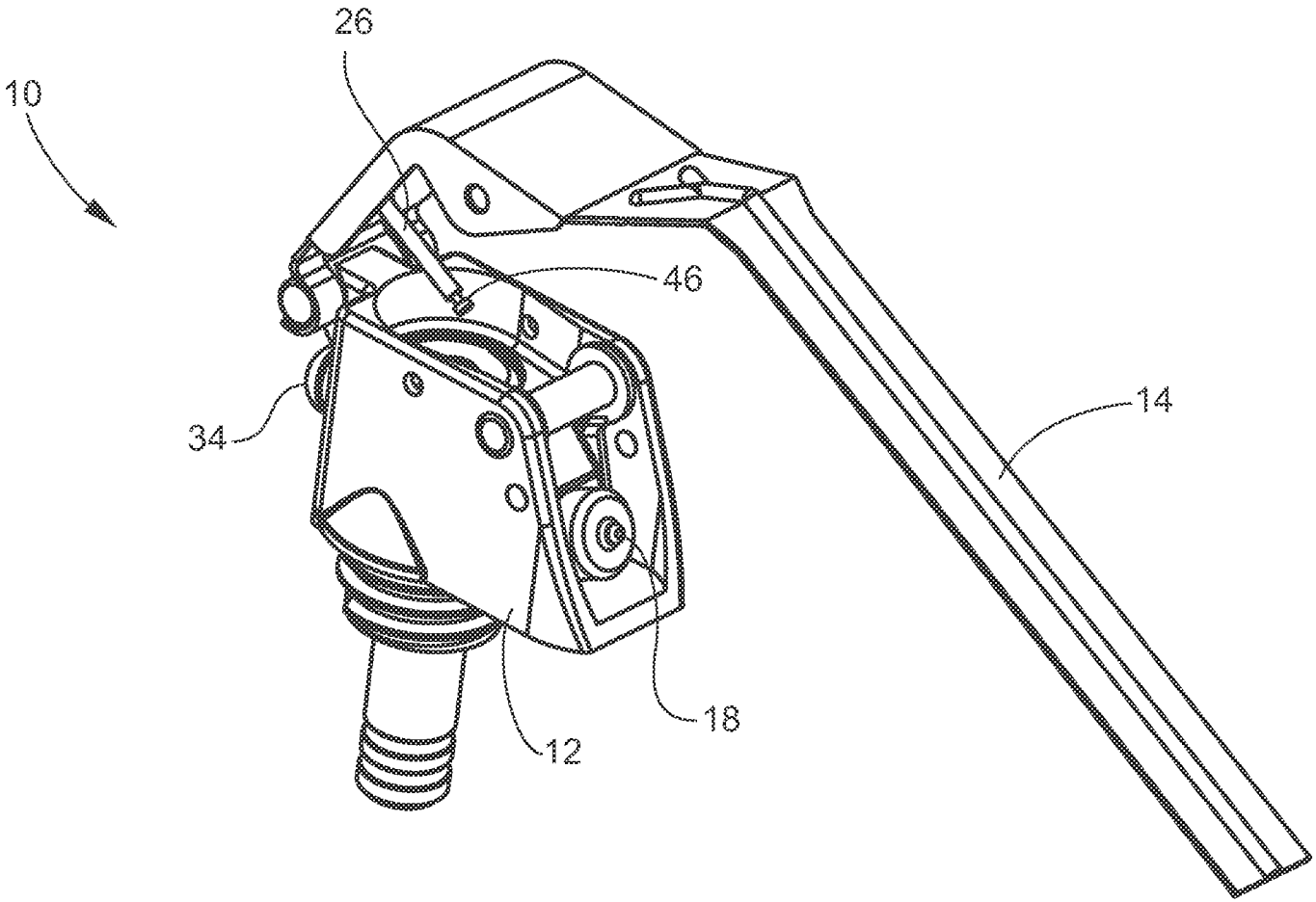
FIG. 3 is a perspective view showing the striker lever in rotation.

FIG. 1 is a side sectional view and FIG. 2 is a perspective view of one embodiment of a novel grenade fuze assembly 10 in a safe (unarmed) state. Fuze assembly 10 includes a fuze body 12 with a striker lever 14 rotatably mounted thereon. A rotor assembly 16 including a firing pin 18 is rotatably mounted to body 12. A spring 20 torsionally biases rotor assembly 16 and striker lever 14 in a counterclockwise direction (as viewed in FIG. 1). Lever 14 and rotor assembly 16 are restrained from rotation by a pull pin 22 fixed to a pull ring 24. Lever 14 is also restrained from rotation by a trigger pin 26 inserted through the lever 14. When the pull pin 22 is removed and the trigger pin 26 is released, the firing pin 18 will rotate counterclockwise and impact the primer 28, thereby beginning the explosive initiation sequence of the grenade (see FIG. 3).

The construction and operation of the pull pin 22 and pull ring 24 are known.

The trigger pin 26 is inserted through the lever 14 and the fuze body 12. As seen in FIGS. 3-6, one end 30 of the trigger pin 26 engages one end of a translatable slide bar 32. The other end of the slide bar 32 engages one end of a trigger 34. Another end of trigger 34 is rotatably fixed to fuze body 12 by, for example, pivot pins 36. A spring 38 is disposed between fuze body 12 and trigger 34. Spring 38 biases trigger 34 away from fuze body 12. Trigger 34 is preferably located on the side of fuze body 12 opposite the side of strike lever 14 so the user can grip the strike lever 14 in the palm of the hand and simultaneously use a finger to operate trigger 34.

Slide bar 32 includes a keyhole opening 40 having a small opening 42 and a large opening 44. End 30 of trigger pin 26 includes an undercut portion 46. Undercut portion 46 has a diameter small enough to fit in small opening 42 and the non-undercut portion of trigger pin 26 is too large to fit in small opening 42. When undercut portion 46 is disposed in small opening 42 (FIG. 5), translation of trigger pin 26 with respect to the slide bar 32 in the direction along the longitudinal axis A of the trigger pin 26 is restrained. In a safe or unactuated position of the fuze assembly 10, undercut portion 46 is inserted in small opening 42. The safe position is maintained by the bias of spring 38 on trigger 34.

Figure 4:
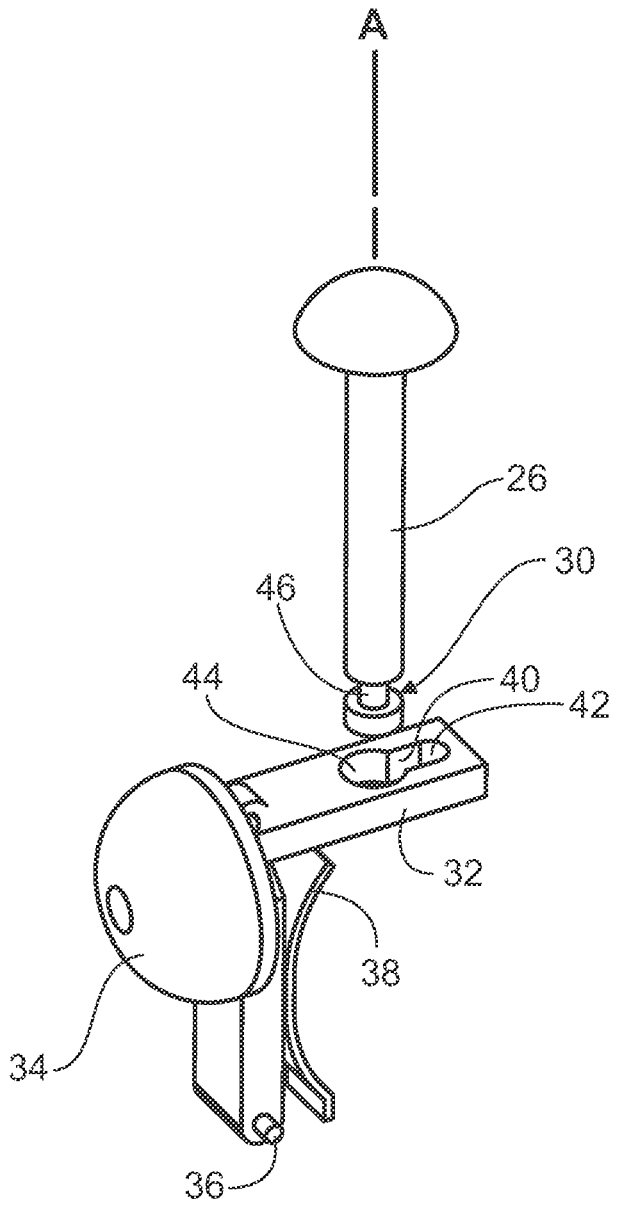
FIG. 4 is an enlarged view of a trigger pin and slide bar.
Figure 5:
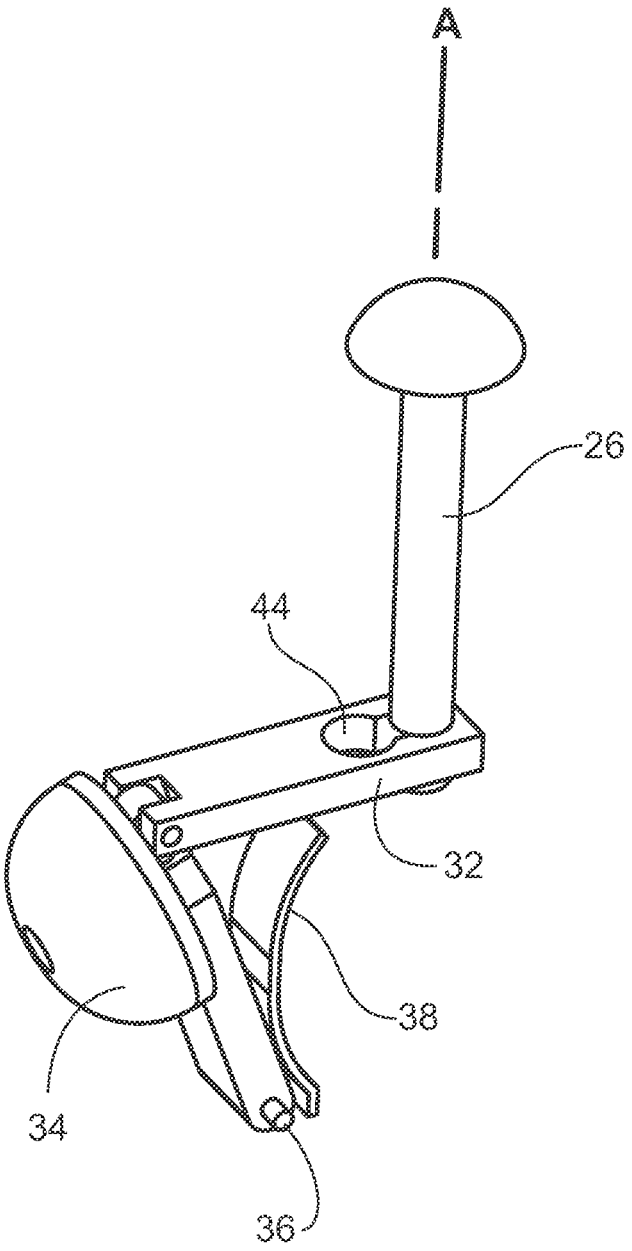
FIG. 5 is an enlarged view showing the trigger pin in a locked position in the slide bar.
Figure 6:
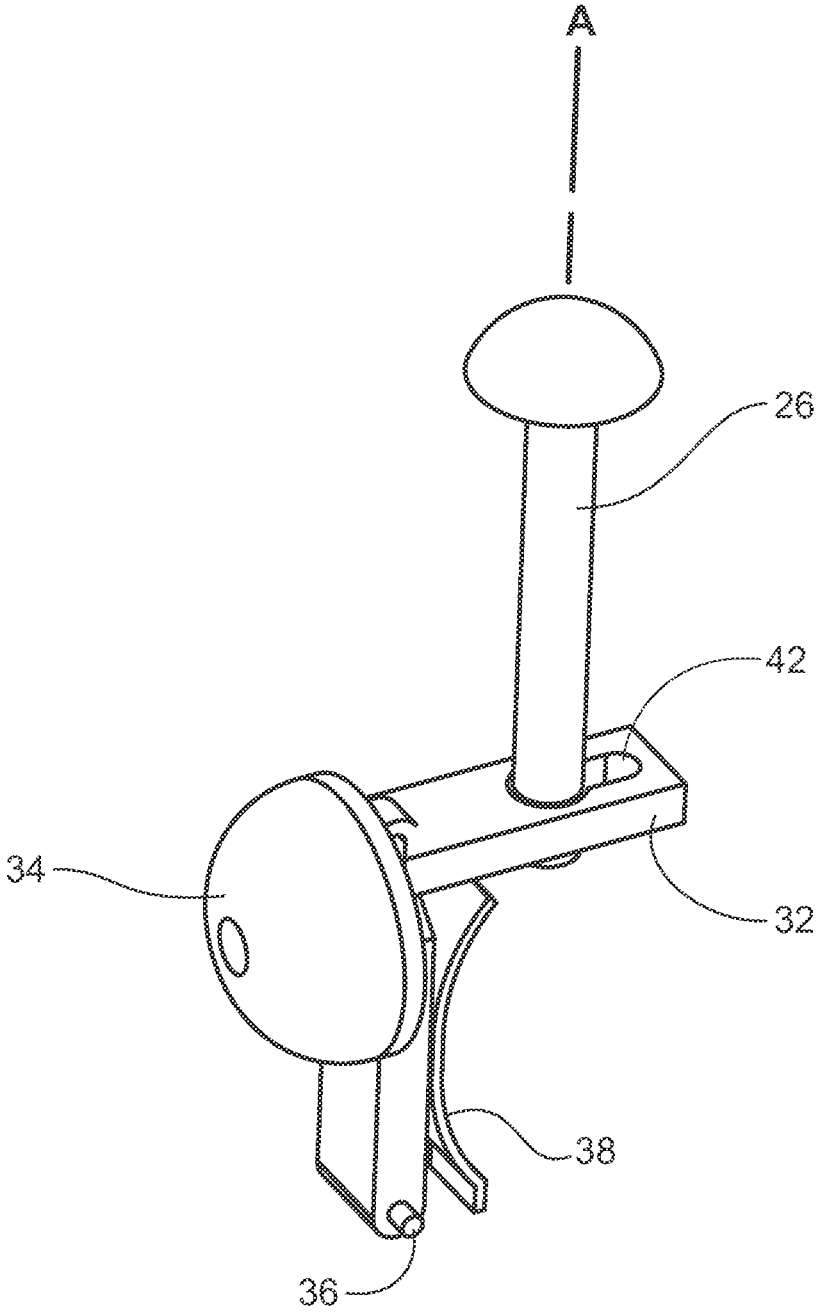
FIG. 6 is an enlarged view showing the trigger pin in an unlocked position in the slide bar.

When trigger 34 is depressed against spring 38, slide bar 32 translates and trigger pin 26 is positioned in large opening 44 of slide bar 32 (FIG. 6). With trigger pin 26 in large opening 44, trigger pin 26 is no longer locked to bar 32 and is free to translate out of large opening 44 and out of slide bar 32 (FIG. 4). Trigger 34 may be depressed by a user's finger.

To arm the fuze assembly 10, trigger 34 is squeezed or depressed so that trigger pin 26 is released from slide bar 32. Then, pull ring 24 is pulled. With trigger 34 depressed and pull ring 24 pulled, the user may release lever 14 by, for example, throwing the grenade. When lever 14 is released (FIG. 3), lever 14 and rotor assembly 16 are free to rotate so that firing pin 18 rotates and impacts primer 28. If the trigger 34 is not depressed and pull ring 24 is pulled, the lever 14 and rotor assembly 16 cannot rotate because of the restraint of trigger pin 26. The trigger pin 26 is a secondary safety feature for the fuze assembly 10.

While the invention has been described with reference to certain embodiments, numerous changes, alterations and modifications to the described embodiments are possible without departing from the spirit and scope of the invention as defined in the appended claims, and equivalents thereof.

What is claimed is:

1. A grenade fuze, comprising:

a fuze body;

a striker lever rotatably mounted to the fuze body;

a rotor assembly rotatably mounted to the fuze body;

a spring that torsionally biases the rotor assembly;

a pull ring having a pull pin that is inserted through the striker lever to restrain rotation of the striker lever and the rotor assembly;

a trigger pin having a longitudinal axis and inserted through the striker lever to restrain rotation of the striker lever, one end of the trigger pin including an undercut portion;

a slide bar disposed in the fuze body and having a keyhole opening at one end for selectively engaging the undercut portion of the trigger pin;

a trigger having one end connected to the slide bar and another end rotatably fixed to the fuze body; and a second spring that biases the trigger away from the fuze body.

2. The fuze of claim 1, wherein the keyhole opening includes a small opening and a large opening and further wherein engagement of the undercut portion of the trigger pin with the small opening restrains translation of the trigger pin with respect to the slide bar in a direction along the longitudinal axis of the trigger pin.

3. The fuze of claim 2, wherein placement of the trigger pin in the large opening of the keyhole opening does not restrain translation of the trigger pin with respect to the slide bar in the direction along the longitudinal axis of the trigger pin.

4. The fuze of claim 1, wherein, in an unactuated position of the trigger, the slide bar prevents translation of the trigger pin with respect to the slide bar in the direction along the longitudinal axis of the trigger pin.

5. The fuze of claim 4, wherein, when the trigger is depressed, the slide bar does not prevent translation of the trigger pin with respect to the slide bar in the direction along the longitudinal axis of the trigger pin.

6. A method of activating a grenade fuze, comprising:

providing the grenade fuze of claim 1;

depressing the trigger; and removing the pull pin from the striker lever.

7. The method of claim 6, wherein depressing the trigger includes translating the slide bar such that the undercut portion of the trigger pin is disengaged from a smaller opening of the keyhole opening.

8. A grenade fuze, comprising:

a fuze body;

a striker lever rotatably mounted to the fuze body;

a rotor assembly rotatably mounted to the fuze body;

a spring that torsionally biases the rotor assembly;

a translatable trigger pin having a longitudinal axis and inserted through the striker lever to restrain rotation of the striker lever, one end of the trigger pin including an undercut portion;

a translatable slide bar disposed in the fuze body and having a keyhole opening at one end for selectively engaging the undercut portion of the trigger pin, the keyhole opening including a small opening and a large opening;

a trigger having one end connected to the slide bar and another end rotatably fixed to the fuze body; and a second spring that biases the trigger away from the fuze body;

wherein engagement of the undercut portion of the trigger pin with the small opening restrains translation of the trigger pin with respect to the slide bar in a direction along the longitudinal axis of the trigger pin and wherein placement of the trigger pin in the large opening of the keyhole opening does not restrain translation of the trigger pin with respect to the slide bar in the direction along the longitudinal axis of the trigger pin.

* * * * *